US008819902B2

(12) United States Patent
Tuma

(10) Patent No.: US 8,819,902 B2
(45) Date of Patent: Sep. 2, 2014

(54) ADHESIVE CLOSURE PIECE

(75) Inventor: Jan Tuma, Herrenberg (DE)

(73) Assignee: Gottlieb Binder GmbH & Co. KG, Holzgerlingen (DE)

( * ) Notice: Subject to any disclaimer, the term of this patent is extended or adjusted under 35 U.S.C. 154(b) by 0 days.

(21) Appl. No.: 13/261,528

(22) PCT Filed: Aug. 10, 2011

(86) PCT No.: PCT/EP2011/004007
§ 371 (c)(1),
(2), (4) Date: Nov. 26, 2012

(87) PCT Pub. No.: WO2012/031658
PCT Pub. Date: Mar. 15, 2012

(65) Prior Publication Data

US 2013/0067702 A1 Mar. 21, 2013

(30) Foreign Application Priority Data

Sep. 8, 2010 (DE) ..... 10 2010 044 660

(51) Int. Cl.
*A44B 18/00* (2006.01)

(52) U.S. Cl.
CPC ..... *A44B 18/0007* (2013.01); *A44B 18/0073* (2013.01); *A44B 18/0049* (2013.01); *A44B 18/0065* (2013.01)
USPC ..... 24/450; 24/442; 24/452

(58) Field of Classification Search
CPC ..... F16B 5/07; B81C 1/00031; B29L 31/729; A61F 13/62; C08L 2201/12
USPC ..... 24/450, 452, 442, 451
See application file for complete search history.

(56) References Cited

U.S. PATENT DOCUMENTS

| | | | | |
|---|---|---|---|---|
| 2004/0020591 | A1* | 2/2004 | Tuma | 156/242 |
| 2004/0134045 | A1* | 7/2004 | Poulakis et al. | 24/442 |
| 2004/0258902 | A1* | 12/2004 | Seth et al. | 428/315.7 |
| 2005/0072509 | A1* | 4/2005 | Full et al. | 156/57 |
| 2007/0063375 | A1* | 3/2007 | Tuma | 264/166 |
| 2009/0126166 | A1* | 5/2009 | Tuma | 24/452 |

FOREIGN PATENT DOCUMENTS

| | | | |
|---|---|---|---|
| DE | 198 28 856 | C1 | 10/1999 |
| DE | 102 07 975 | A1 | 2/2003 |
| DE | 698 27 297 | T2 | 2/2006 |
| DE | 10 2006 024014 | A1 | 11/2007 |
| DE | 10 2006 050 365 | A1 | 4/2008 |
| DE | 10 2008 027860 | A1 | 12/2009 |
| DE | 10 2009 006 358 | A1 | 7/2010 |
| GB | 2 279 106 | A | 12/1994 |
| WO | WO 03/099951 | A2 | 12/2003 |
| WO | WO 2005/087033 | A1 | 9/2005 |

* cited by examiner

*Primary Examiner* — Robert J Sandy
*Assistant Examiner* — Rowland Do
(74) *Attorney, Agent, or Firm* — Roylance, Abrams, Berdo and Goodman LLP

(57) ABSTRACT

An adhesive closure piece (10) includes a substrate part (12) and closure pieces (20*a*, 20*b*) of at least one type arranged upright on the substrate part. The closure pieces each have a head part (14*a*, 14*b*) having at its free end face at least one contact surface (22*a*, 22*b*) for detachably adhering to another component by adhesive force. The closure piece has at least one connection section (16*a*, 16*b*) on the edge of each head part (14*a*, 14*b*). The connection section protrudes beyond the edge of the head part (14*a*, 14*b*) in at least one direction (30, 36) such that the size of the contact surface (22*a*, 22*b*) of the corresponding head part (14*a*, 14*b*) is changed.

17 Claims, 4 Drawing Sheets

ADHESIVE CLOSURE PIECE

FIELD OF THE INVENTION

The invention relates to an adhesive closure piece comprising a backing part and closure parts arranged in an upright manner on the backing part. Each closure part has a head part having a free end face with at least one contact surface for adhering to a second or third component by an adhesive force such that the contact surface can be detached again.

BACKGROUND OF THE INVENTION

WO 03/099951 A2 discloses methods for modifying the surfaces of an object to enhance the adhesive force of the object. For this purpose, the surface is subjected to a structuring process, so that a plurality of projections are formed. Each of these projections comprises a foot part and a head part. The foot part has an end face that faces away from the surface. At the same time, each projection is dimensioned such that all of the end faces have the same vertical height above the surface and form a common contact surface interrupted by a mutual spacing between the end faces. The projections are elastic and inclined in relation to the surface and are made of a material having a modulus of elasticity reduced in at least one of the reference directions. These directions comprise a longitudinal direction of each projection from the foot part to the head part and a transverse direction of each projection taken axially from the middle of the foot part to the outside. Portions of the contact surface can have a weaker separation force to facilitate an initial opening up of the adhesive connection, while other portions require a stronger separation force.

Contact surfaces in a magnitude of 0.2 to 0.5 $\mu m^2$ enable an interaction with a corresponding additional component (second or third component), to which the touch-and-close fastener part is to be secured by Van der Waals interaction, considered to be in classical terms a subgroup of adhesion. The prior art touch-and-close fastener part exhibits good connecting properties, but is associated with a time-consuming and, thus, cost-intensive manufacturing process. Since the arrangement between the head part, typically having the shape of a mushroom, and the backing part of stem parts arranged such that they are exclusively inclined, is relatively rigid. Still room exists for improved solutions with respect to the adhesion and separation properties of the touch-and-close fastener part or, more specifically, the individual closure parts.

SUMMARY OF THE INVENTION

An object of the present invention is to provide improved adhesion and separation properties of the touch-and-close fastener part at a second or third component to eliminate excessive loads on and damages to the closure parts.

This object is basically achieved with a touch-and-close fastener part where the edge of at least one of the head parts has, connected thereto, at least one connecting section. The connecting section projects beyond the edge of the head part in at least one direction such that the result is a change in the effective size of the contact surface for the corresponding head part. The contact surface of at least one head part is modified such that it is enlarged or decreased. At least one tear-off edge is defined on the at least one connecting section. This tear-off edge facilitates the separation of the contact surface from a second or third component.

It is expedient for the at least one connecting section to result in an enlargement of the corresponding contact surface. It is especially preferred that the complete area of at least one connecting section be available as an additional contact surface.

A connection on the edge side, as defined by the invention, means that the at least one connecting section is connected to the respective head part in an edge region. This structure can be, for example, an edge section of the contact surface located on the end face side, but also on a side section of the respective head part connected directly or indirectly to the contact surface. Expediently the at least one connecting section can be connected to the respective head part in an edge region on the end face side. Typically, the corresponding head part is designed in the shape of a mushroom and tapers off from the edge region on the end face side in the direction of the backing part or, more specifically, in the direction of a stem part that connects the respective head part with the backing part.

Preferably the touch-and-close fastener part according to the invention has the at least one connecting section extending in the direction of extension of the respective contact surface. In this arrangement, the at least one connecting section results in a widening of the respective contact surface in the direction of the respective extension. As especially preferred, the respective connecting section is connected directly to the respective contact surface in the direction of extension. However, the respective connecting section can be arranged at a distance from the contact surface and/or can not be connected to an edge region of the respective head part. This edge region, located on the end face side, directly abuts the respective contact surface. In such designs, the entire contact surface exhibits a higher flexibility, because the contact surface on the end face side and the respective connecting section are connected to a third component in varying angular positions and can enter into an adhesive connection with this third component.

Expediently, at least one connecting section has regions of varying width and/or thickness, in particular a thickness that decreases in the direction of the free edge, along the extension of the connecting section. As a result, the edge of the at least one connecting section or more specifically the respective contact surface has edge sections comparable to a thin lip that are easy to apply and detach. Furthermore, advantageously the at least one connecting section is made of the same material as the respective head part and, in particular, to mold the connecting section to this respective head part. In addition, the at least one connecting section and/or the corresponding head part can be an independent component that can be connected to the corresponding head part or more specifically the closure part. The result is the advantage that the respective connecting sections and/or head parts can be manufactured independently of the rest of the touch-and-close fastener part and can be connected to or placed on the closure part as a function of the respective application. To further develop specific properties of the connecting sections, a material can be selected other than the materials used for the rest of the closure parts. In particular, a material can be selected with good elasticity and adhesion properties.

At least one connecting section is designed preferably as a tooth, a serration, and/or a tab. The teeth, the serrations, and/or the tabs can be formed by molding at least one connecting section to the head part or by introducing notches or, respectively, recesses into the respective head part. With that at least one connecting section, the tear-off edges that are arranged on the edge side are fixed in a defined way. Expediently the teeth, the serrations, and/or the tabs have in each instance a shape in the form of a triangle. Furthermore, at least one connecting section can be designed in the manner of a comb and/or in the shape of a wave. A sinusoidal pattern of the free edge of the connecting section is also conceivable. Moreover, advantageously a plurality, at least two, connecting sections can be provided on the respective head part. In this case, the connecting sections can preferably be arranged and/or formed at regular intervals on the respective head part, even more preferred along its edge. In so doing, identical or different connecting sections can be provided on a head part.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure and which are highly schematic and not drawn to scale.

DETAILED DESCRIPTION OF THE INVENTION

Figure 1:
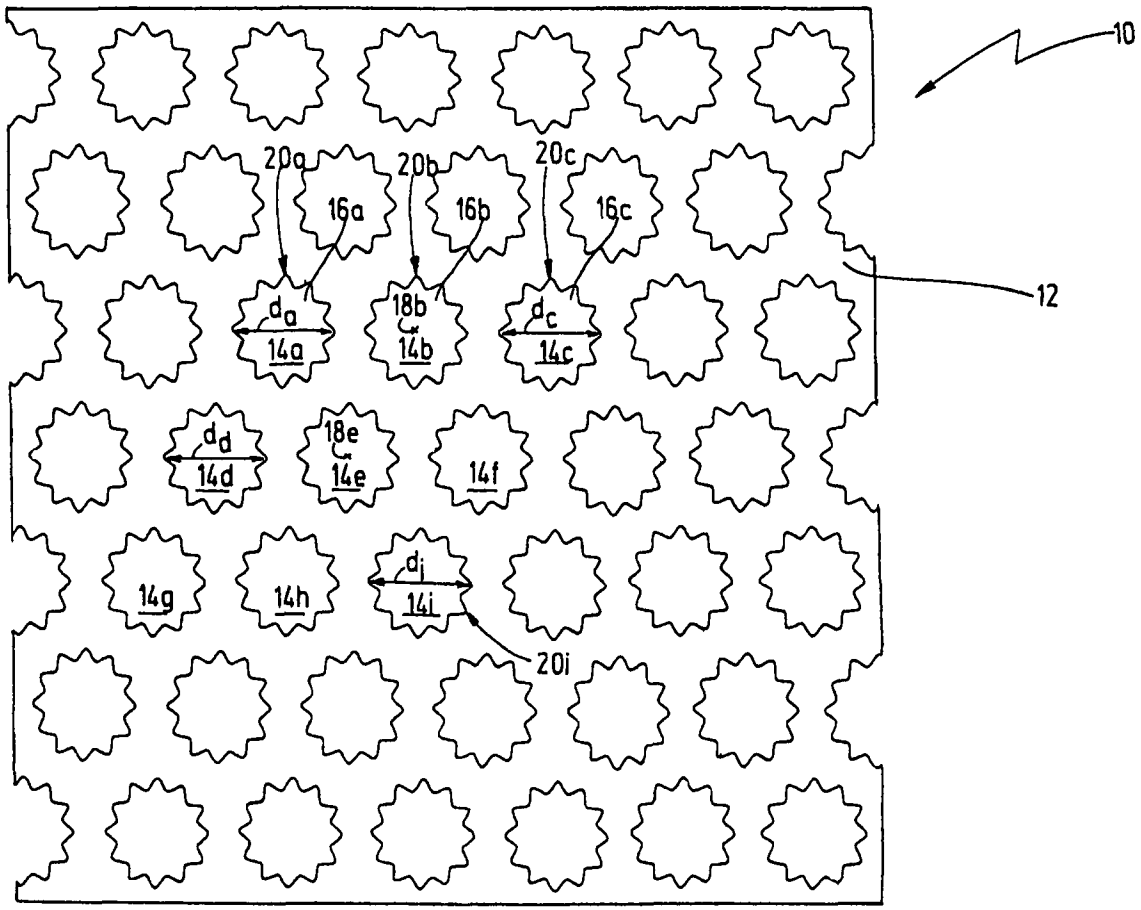
FIG. 1 is a top plan view of a touch-and-close fastener part according to first exemplary embodiment of the invention.

FIG. 1 shows a section of a touch-and-close fastener part 10 comprising a backing part 12, on which closure parts 20*a*-20*i* are arranged with a head part 14*a*-14*i* visible in each instance. The head parts 14*a*-14*i* have in each instance connecting sections 16*a*-16*i*, arranged on the edge side. The regular arrangement of the connecting sections produces an outer edge in the manner of a rosette on the head part. Furthermore, each head part 14*a*-14*i* and the corresponding closure part 20*a*-20*i* are designed such that they are rotationally symmetrical relative to the respective center point 18*a*-18*i*. This feature offers the advantage that the properties of the respective head part 14*a*-14*i* or more specifically the closure part 20*a*-20*i* are identical in all radial directions. The maximum radial extension $d_a$-$d_i$ of the respective head parts 14*a*-14*i* amounts to approximately 40 μm. In the illustrated exemplary embodiment, approximately twelve closure parts 20*a*-20*i* are arranged in a surface section of 200 μm×200 μm. As a result of the uniform design and the arrangement of the individual closure parts 20*a*-20*i*, the touch-and-close fastener part 10 exhibits homogeneous properties.

Figure 2A:
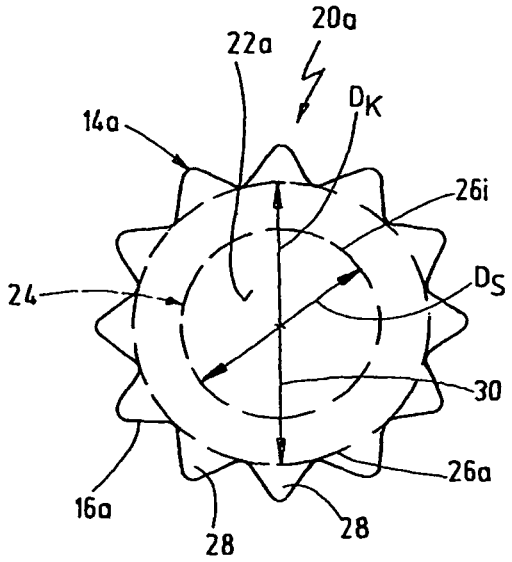
FIGS. 2*a*-2*d* are each a top plan view of the first, a second, a third and a fourth exemplary embodiments of a head part according to the invention, respectively.

FIG. 2*a* is an enlarged view of the closure part 20*a* and, respectively, the head part 14*a*. The head part 14*a* defines a contact surface 22*a* on the illustrated end face. This contact surface has more or less the shape of a circle with a diameter $D_K$, indicated with the circular line 26*a*. An inner circular line 26*i* indicates the radial extension $D_S$ of the stem part 24. The contact surface 22*a* is enlarged by the connecting sections 16*a*, designed as teeth 28 and arranged at regular intervals along the outer circular line 26*a*.

Figure 2B:
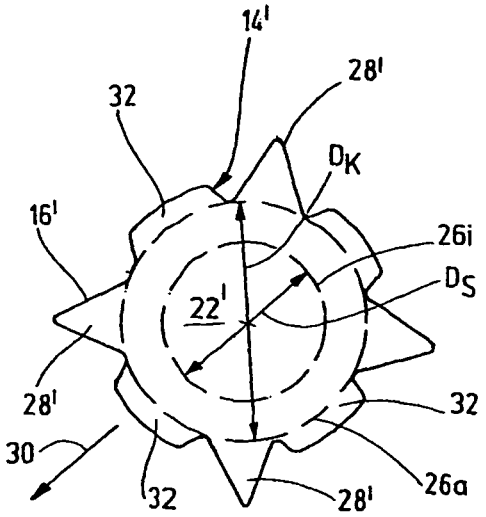

An alternative embodiment of the connecting sections 16', arranged on a head part 14', is shown in FIG. 2*b*. The connecting sections 16' are designed as alternating teeth 28' and tabs 32. The teeth 28' are formed in each instance in the shape of a triangle and taper to a point in the radial direction 30. In contrast to the rectangular tabs 32, the teeth have a larger extension in the radial direction 30, but have a smaller extension along the outer circular line 26*a*. Even in the embodiment shown in FIG. 2*b*, the connecting sections 16', connected directly to the contact surface 22' in the radial direction 30 and have the shape of teeth 18' and tabs 32, result in an enlargement of the contact surface.

Figure 2C:
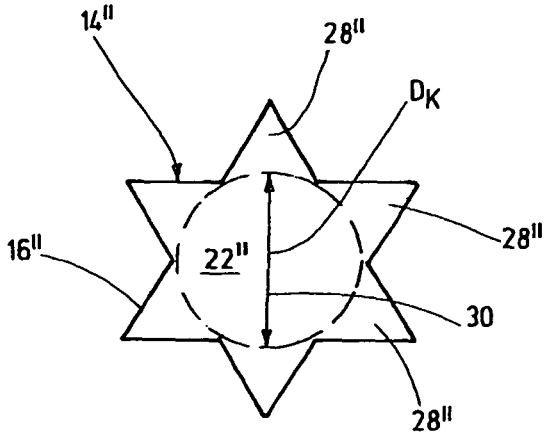

FIG. 2*c* shows the outer contour of a contact surface 22". This outer contour exhibits the pattern of an n-on, here a hexagon. Six identical connecting sections 16" in the form of triangular teeth 28" are molded to a head part 14" that has the shape of a mushroom, thus forming a twelve-sided figure outer contour of the contact surface 22".

Figure 2D:
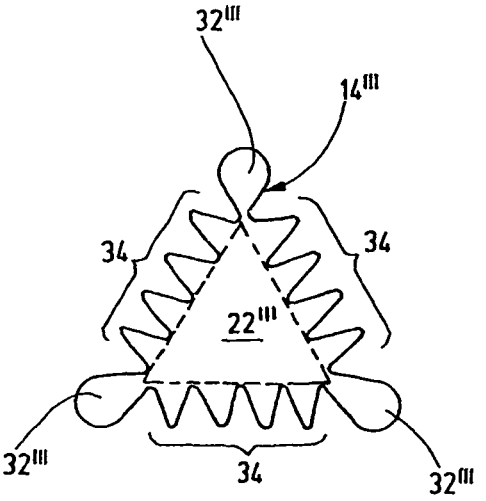

FIG. 2*d* shows a contact surface 22''' having a size that is enlarged by tabs 32''' and comb sections 34 that are connected to the edge of the triangular contact surface 22''' or more specifically the head part 14". The three comb sections 34 are arranged along the sides of the equilateral triangle; and the tabs 32''' are arranged at the three corners of the equilateral triangle. FIG. 2*d* shows very clearly that the shape of the head part 14''' is not limited to a mushroom, i.e., a round shape, but rather can also have an angular shape.

Figure 3:
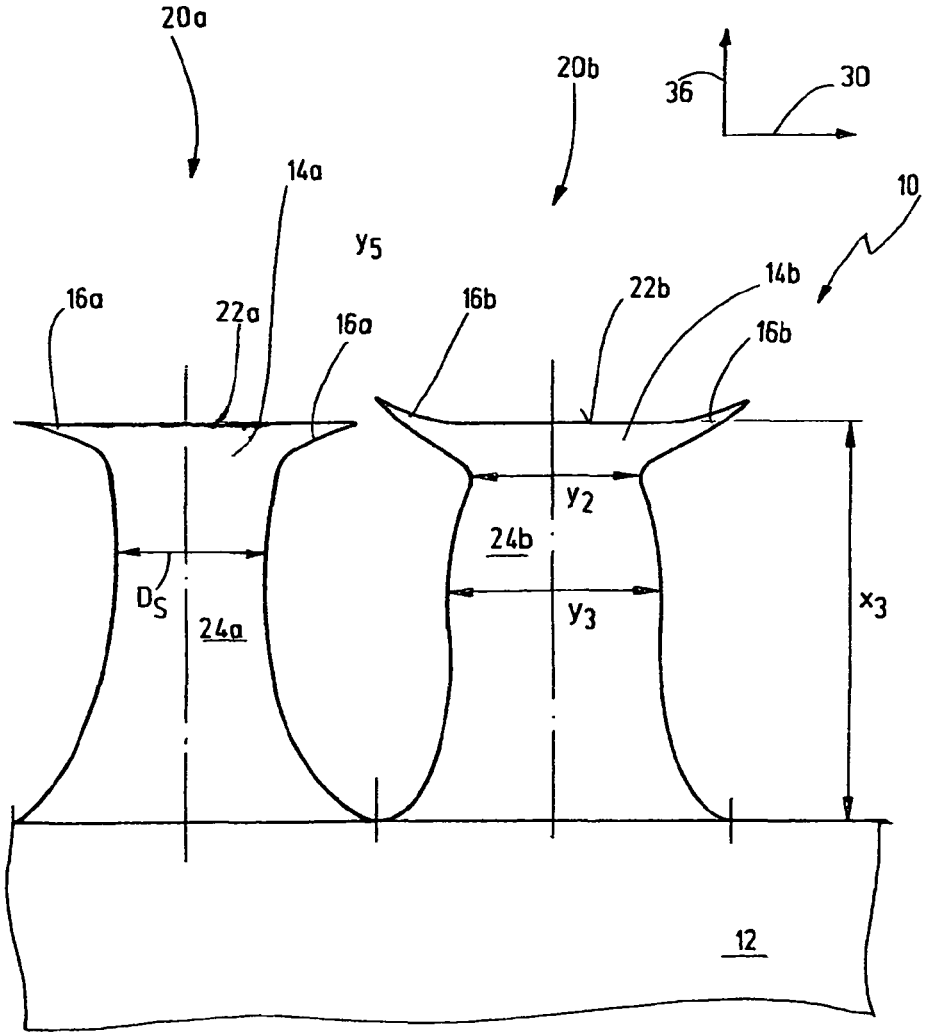
FIG. 3 is a side elevational view in section of two closure parts of FIG. 1.

FIG. 3 is a longitudinal view of the closure parts 20*a*, 20*b* of the touch-and-close fastener part 10 shown in FIG. 1. The closure parts 20*a*, 20*b* stand more or less perpendicular on the backing part 12. The contact surfaces 22*a*, 22*b* are formed on the head parts 14*a*, 14*b*, and extend in each instance more or less parallel to the backing part 12 and in a plane spaced equidistant $x_3$ from the backing part 12. The major distinction between the two closure parts 20*a*, 20*b* lies in the fact that the stem part 24*a* extending from the head part 14*a* to the backing part 12 has in essence the same thickness $D_S$, whereas the stem part 24*b* has a tapering $y_2$ and a widening $y_3$. The connecting sections 16*a* that are connected to the head part 14*a* on the edge side extend in conformity with the contact surface 22*a* in the radial direction 30 and enlarge, when directly connected, the contact surface 22*a*.

In contrast, the connecting sections 16*b*, provided on the head part 14*b*, are oriented transversely to the radial direction 30 and to the axial direction 36. The end face of the contact surface 22*b*, enlarged by the connecting sections 16*b*, has surface regions oriented in a radial direction 30, and surface regions are oriented transversely to the radial direction 30. It is very clear from FIG. 3 that the respective connecting sections 16*a*-16*b* are designed in the form of a thin lip and have a thickness that decreases in the direction of the free edge. However, alternative solutions are also conceivable. For example, the respective connecting section can be connected to the free outer edge of the corresponding head part such that the connecting section has a constant thickness or, respectively material strength without tapering outwards in the form of a lip, a feature that results, in this respect, in an advantageous support of the above-described tear-off edge or the tear-off line. The illustrated rotational symmetry of the closure parts 20*a* and 20*b* is practical in terms of rotational invariance properties.

Figure 4:
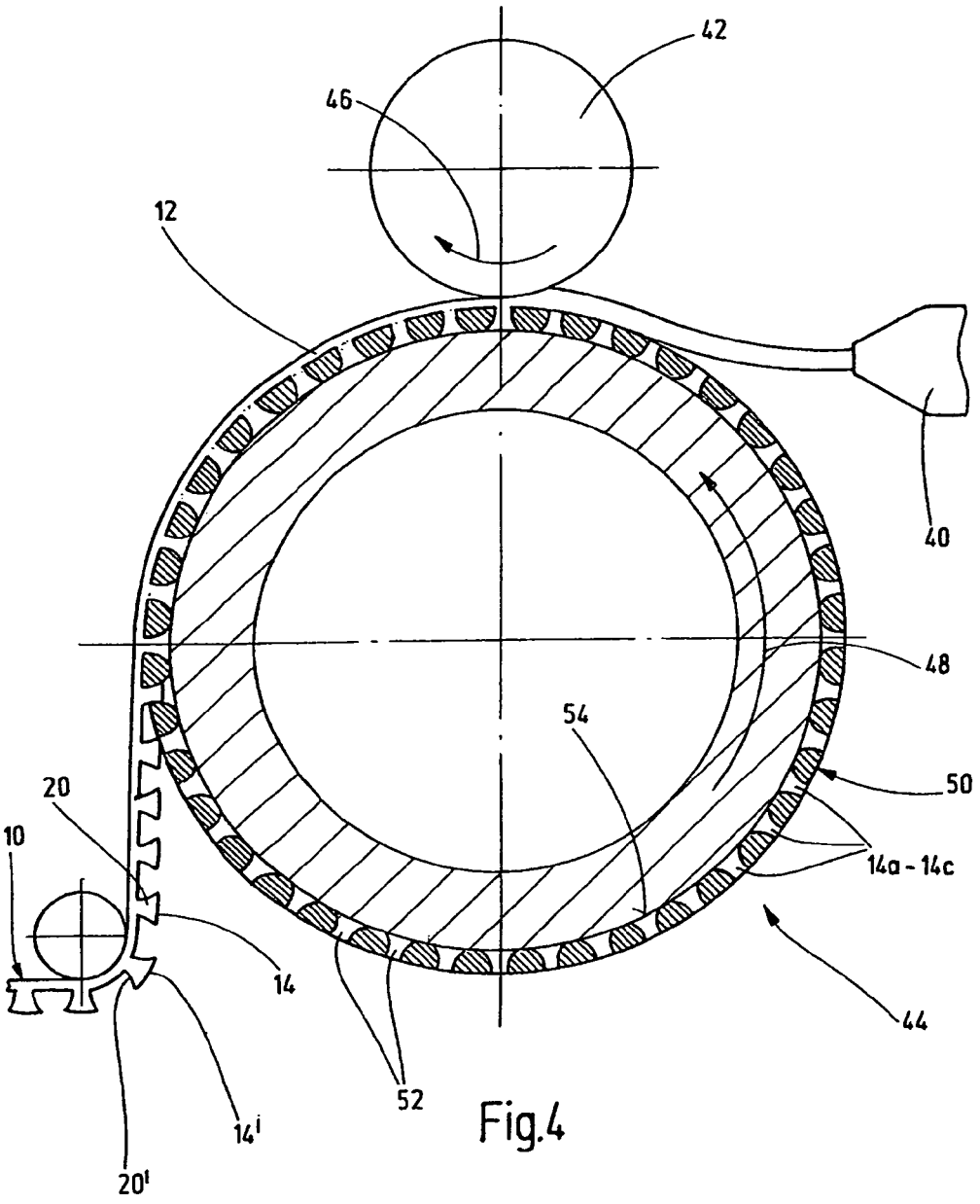
FIG. 4 is a side elevational view in section of a device for carrying out a method for manufacturing a touch-and-close fastener part according to the invention.

FIG. 4 illustrates the method for manufacturing the touch-and-close fastener part 10. A synthetic plastic material is extruded from an extruder head 40 and is conveyed between a pressure roller 42 and a forming roller 44. The pressure roller 42 moves into a first movement direction 46. The forming roller 44 moves into a second movement direction 48 opposite the first movement direction 46. The shell of the forming roller 44 is provided with a forming screen 50, in which mold cavities 52 are formed in conformity with the closure parts 20 that are to be formed. The mold cavities 52 are formed on an interior 54 in conformity with the head parts 14*a*-14*c* and the connecting sections provided on said head parts. The rotational movement of both rollers 42, 44 forces the synthetic plastic material fed into a gap formed by the two rollers into the mold cavities 52 of the forming screen 50. The closure parts 20 are made of a synthetic plastic material on the side of the backing part 12 assigned to the forming roller 44. After the closure parts 20 have cured and are demolded or, more specifically, removed from the corresponding mold cavities 52, a touch-and-close fastener part 10, comprising a backing part 12 and closure parts 20, 20' arranged to stand upright on the backing part and with head parts 14, 14' is ready for immediate use. Then, the forming screen 50 has, when viewed from the free end face, mold recesses, as shown, by way of example, in FIG. 1 for a completed head shape of the end product. Instead of an extrusion process using preferably thermoplastic materials, it is also possible to process two component mixtures or multicomponent mixtures, such as polyvinyl siloxane, using mold cavities.

The backing part 12 is made in an advantageous way in one piece with the closure parts 20, 20'. Furthermore, the respective synthetic plastic material can be processed by microreplication technology. Other methods for manufacturing the touch-and-close fastener part or more specifically the closure parts 20 include not only the chill method and the roll method, but also microlithographic or nanolithographic methods, including so-called micro printing. In any event, the described microstructure can also be achieved with a kind of crystal growth. Moreover, the closure material can also be generated from solids, for example, with the use of micro spark erosion or a suitable laser beam machining.

In addition, the invention provides that the closure parts 20, 20*a*-20*i* can be fabricated separately, stockpiled, and/or transported and connected, as required, to a corresponding backing part 12 or rather can be arranged on the backing part. In particular, different kinds of closure parts, for example, adhesive closure parts modified according to the invention, interlocking parts, and loop parts, can be arranged on a backing part 12. Other functional elements can be provided, as a function of the application, on the backing part 12. In particular, the closure parts can be arranged on one side or both sides of the backing part 12.

While various embodiments have been chosen to illustrate the invention, it will be understood by those skilled in the art that various changes and modifications can be made therein without departing from the scope of the invention as defined in the appended claims.

What is claimed is:

1. An adhesive touch-and-close fastener part, comprising:

a backing part;

closure parts extending upright from said backing part, each said closure part having a head part with a free end face, each said free end face having a contact surface for detachably adhering to at least one of a second and third components by an adhesive force; and a plurality of connecting sections coupled to an edge of each said head part and projecting beyond the edge of the respective head part in at least one direction to change a size of the contact surface of the respective head part, said connecting sections being arranged and spaced from one another on each said head part at regular intervals.

2. An adhesive touch-and-close fastener part according to claim 1 wherein said connecting sections enlarge the contact surface of the respective head part.

3. An adhesive touch-and-close fastener part according to claim 1 wherein said connecting sections are molded on end face-side edge regions of said head parts.

4. An adhesive touch-and-close fastener part according to claim 1 wherein said connecting sections on each said head part extend in directions along extensions of the respective contact surface.

5. An adhesive touch-and-close fastener part according to claim 1 wherein said connecting sections are inclined relative to extension thereof from the respective head part.

6. An adhesive touch-and-close fastener part according to claim 5 wherein said connecting sections are inclined in a direction away from said backing part.

7. An adhesive touch-and-close fastener part according to claim 1 wherein each said connecting section has regions of varying width and thickness.

8. An adhesive touch-and-close fastener part according to claim 7 wherein each said connecting section decreases in thickness in a direction of a free edge thereof and along an extension thereof from the respective head part.

9. An adhesive touch-and-close fastener part according to claim 1 wherein said connecting sections are made of the same materials as the head parts.

10. An adhesive touch-and-close fastener part according to claim 9 wherein said connecting sections are molded to said head parts.

11. An adhesive touch-and-close fastener part according to claim 1 wherein said connecting sections are independent components connected to said head parts.

12. An adhesive touch-and-close fastener part according to claim 1 wherein said connecting sections on each said head parts comprise a series of teeth.

13. An adhesive touch-and-close fastener part according to claim 1 wherein said connecting sections on each said head part comprise sections.

14. An adhesive touch-and-close fastener part according to claim 1 wherein said connecting sections comprise tabs.

15. An adhesive touch-and-close fastener part according to claim 1 wherein said connecting sections on each said head part define a comb.

16. An adhesive touch-and-close fastener part according to claim 1 wherein said connecting sections on each said head part form a wave shape.

17. An adhesive touch-and-close fastener part according to claim 1 wherein said closure part adheres to at least one of the second and third component by Van der Waals interaction.

* * * * *